US008284964B2

(12) United States Patent
Windischberger et al.

(10) Patent No.: US 8,284,964 B2
(45) Date of Patent: Oct. 9, 2012

(54) COMPOUND MEMBRANE, METHOD OF MANUFACTURING THE SAME, AND ACOUSTIC DEVICE

(75) Inventors: Susanne Windischberger, Vienna (AT); Josef Lutz, Rohrau (AT); Ewald Frasl, Biedermannsdorf (AT)

(73) Assignee: Knowles Electronics Asia PTE. Ltd., Singapore (SG)

( * ) Notice: Subject to any disclaimer, the term of this patent is extended or adjusted under 35 U.S.C. 154(b) by 523 days.

(21) Appl. No.: 12/513,881

(22) PCT Filed: Oct. 16, 2007

(86) PCT No.: PCT/IB2007/054210

§ 371 (c)(1),
(2), (4) Date: May 7, 2009

(87) PCT Pub. No.: WO2008/056287

PCT Pub. Date: May 15, 2008

(65) Prior Publication Data

US 2010/0040246 A1 Feb. 18, 2010

(51) Int. Cl.
*H04R 25/00* (2006.01)
*H04R 7/00* (2006.01)

(52) U.S. Cl. ..... 381/150; 381/116; 381/174; 381/191; 381/426; 381/428; 181/165; 181/170; 162/128; 310/324; 310/328; 310/330; 310/348; 427/294

(58) Field of Classification Search ..... 381/116, 381/150, 174, 191, 426, 428; 181/164, 170; 162/128, 157; 310/324, 328, 330, 348; 427/294
See application file for complete search history.

(56) References Cited

U.S. PATENT DOCUMENTS

| | | | | |
|---|---|---|---|---|
| 4,343,376 | A * | 8/1982 | Tsukagoshi et al. | 181/167 |
| 5,162,619 | A * | 11/1992 | Thiele et al. | 181/166 |
| 7,336,797 | B2 * | 2/2008 | Thompson et al. | 381/418 |
| 2008/0017304 | A1 * | 1/2008 | Sell et al. | 156/250 |

FOREIGN PATENT DOCUMENTS

| | | | |
|---|---|---|---|
| EM | 1 429 582 | A | 6/2004 |
| EP | 0 297 572 | A | 1/1989 |
| GB | 2 051 106 | A | 1/1981 |
| JP | 07 284194 | A | 10/1995 |
| JP | 04 042699 | | 2/1999 |
| JP | 2001-059057 | | 3/2001 |
| JP | 2003-244788 | | 8/2003 |

* cited by examiner

*Primary Examiner* — Dao H Nguyen
(74) *Attorney, Agent, or Firm* — Steven McMahon Zeller; Dykema Gossett PLLC

(57) ABSTRACT

A compound membrane (100) for an acoustic device (200), the compound membrane (100) comprising a first layer (101) and a second layer (102), wherein a value of Young's modulus of the second layer (102) does not vary more than essentially 30% in a temperature range between essentially −20° C. and essentially +85° C.

12 Claims, 1 Drawing Sheet

COMPOUND MEMBRANE, METHOD OF MANUFACTURING THE SAME, AND ACOUSTIC DEVICE

FIELD OF THE INVENTION

The invention relates to a compound membrane.

Moreover, the invention relates to a method of manufacturing a compound membrane.

Furthermore, the invention relates to an acoustic device.

BACKGROUND OF THE INVENTION

Nowadays, speakers and/or microphones often comprise compound membranes which are basically a combination of layers of different materials or just a mixture of different materials.

JP 04-042699 discloses a diaphragm for a speaker made of a composite material being a composition of a thermoplastic synthetic resin fiber having a high glass transition temperature with a thermoplastic synthetic resin fiber having a low glass transition temperature being raw materials of two kinds of thermoplastic synthetic resin fibers having different glass transition temperatures heated at the forming. That is, the glass transition temperature of the composite takes a value between the individual glass temperatures and a large internal loss shall be obtained with a wider temperature range in comparison with the case with complete mixture of the two kinds of synthetic resins.

However, conventional acoustic devices suffer from a non-sufficient lifetime.

OBJECT AND SUMMARY OF THE INVENTION

It is an object of the invention to provide an acoustic system which has a reasonably large lifetime.

In order to achieve the object defined above, a compound membrane for an acoustic device is provided, the compound membrane comprising a first layer and a second layer, wherein a value of Young's modulus of (a material of) the second layer does not vary more than 30% in a temperature range between −20° C. (degree Celsius) and +85° C.

In order to achieve the object defined above, furthermore an acoustic device is provided comprising a compound membrane having the above mentioned features.

In order to achieve the object defined above, finally a method of manufacturing a compound membrane for an acoustic device is provided, the method comprising providing a first layer and a second layer, wherein a value of Young's modulus of the second layer does not vary more than 30% in a temperature range between −20° C. and +85° C.

The term "acoustic device" particularly denotes any apparatus which is capable of generating sound for emission to an environment and/or for the detection of sound present in the environment. Such an acoustic device particularly includes any electromechanical transducer or piezoelectric transducer capable of generating acoustic waves based on electric signals, or vice versa.

The term (oscillatory) "compound membrane" particularly denotes any multi-layer diaphragm which oscillates under the influence of a mechanical force and thereby generates sound. However, such an oscillatory compound membrane can also receive sound and convert it into mechanical oscillations for supply to a transducing element. Such a compound membrane may be formed of a plurality of different components and/or materials.

The term "thermoplastic" defines a material capable of softening when heated to change shape and capable of hardening when cooled to keep shape. This property may be maintained repeatedly, even after a plurality of heating/cooling cycles.

The term (thermoplastic) "layer" particularly denotes any physical structure (comprising a thermoplastic material) including a continuous uninterrupted two-dimensional area or a discontinuous structure like an annular structure or a structure comprising two or more non-connected portions.

The term "acoustically damping" particularly denotes a material property which makes it possible to selectively damp acoustic waves. Particularly, such an acoustically damping member can damp standing waves on a diaphragm. Usually, in an acoustic device, an acoustic ground mode is desirable to obtain a proper audio performance, and excited modes may be disturbing and should therefore be suppressed by damping.

The term "Young's modulus" E (which is also refered to as the modulus of elasticity, elastic modulus or tensile modulus) denotes a modulus of elasticity describing a material property or parameter which is equal to a ratio between a mechanical tension and a corresponding elongation. Therefore, rigid materials have a larger value of Young's modulus than flexible materials. The parameter value of Young's modulus may be temperature-dependent and may strongly vary in a narrow temperature range around a so-called glass transition temperature. The Young's modulus can be experimentally determined from the slope of a stress-strain curve created during a tensile test conducted on a sample of the material.

The term "glass transition temperature" denotes a material property of a thermoplastic material or other materials, in particular a temperature range at which molecules perform a transition from a "frozen" state into a state with an increased Brownian motion. The material therefore changes from a rigid, hard, brittle state to an elastic, rubber-like state. Around the glass transition temperature, a value of Young's modulus of elasticity of the material can strongly vary. Since a glass transition range can also be dependent on a frequency (of acoustic waves), the term glass transition temperature, in the context of this application, denotes the glass transition temperature at the respective resonance frequency of an acoustic device, for instance of a loudspeaker. Such a resonance frequency may particularly be in a range between essentially 20 Hz and essentially 10000 Hz, particularly in a range between essentially 200 Hz and essentially 1300 Hz. The glass transition temperature for a foil, in the context of the application, can be measured by a dynamic mechanical analysis (DMA).

The term "electrodynamic acoustic device" denotes an acoustic device which converts acoustic waves into electric signals, or vice versa, using an electromagnetic principle, for instance a coil and a magnet configuration.

The term "piezoelectric acoustic device" denotes an acoustic device which is based on the piezoelectric effect. For instance, such a device is adapted as a piezoelectric microphone. A piezoelectric microphone uses the phenomenon of piezoelectricity—the tendency of some materials to produce an electric voltage when subjected to a mechanical pressure, or vice versa—to convert vibrations into an electrical signal. However, the device may also be adapted as a piezoelectric loudspeaker based on the phenomenon of piezoelectricity.

According to an embodiment of the invention, a multi-layer compound membrane for an electroacoustic transducer is provided in which a top layer (which may significantly contribute to the damping properties of the compound membrane) may be made of a material having a value of Young's module which is not altered by more than approximately 30% in a temperature range between approximately −20° C. and 85° C. The temperature of 85° C. is an upper temperature value at which acoustic devices are usually employed. Such a temperature can occur, for instance, when a mobile phone (having a loudspeaker) is stored in a hot car on a sunny day. However, at temperatures significantly below −20° C. (particularly at −55° C. and below), the compound membrane can become too brittle (resulting in a small life time) and too hard or rigid (so that it may become difficult or impossible that the membrane follows acoustic excitations). Therefore, a sufficiently small variation of Young's module (and consequently sufficiently stable acoustic playback and/or detection properties) in the described temperature range is advantageous to obtain a high quality compound membrane. Thus, such a diaphragm has a damping layer which is neither too soft nor too hard and in addition has sufficiently stable acoustic properties at the operating temperature of a speaker or microphone. Therefore, an improved or optimized material configuration is obtained to ensure process stability and lifetime for speaker membranes.

Conventionally, speakers often have compound membranes which consist of a relatively hard thermoplastic (for instance polycarbonate) and a relatively soft damping layer (for instance a glue layer, which may also be a thermoplastic layer). These damping layers normally have an unfavourable glass transition temperature (this temperature marks the border between the soft and the hard range of the material).

Embodiments of the invention overcome drawbacks of such conventional membranes, which show the tendency that the mechanical properties of the damping layer and therefore the acoustic properties of the membrane vary a lot close to a glass transition temperature. In other words, a small temperature change causes a big change with regard to acoustic properties. This is highly undesirable when this happens at an operating temperature of a speaker. Controlling the manufacturing process of speakers by use of its acoustic properties (i.e. changing parameters of the process after having measured the sound performance of a speaker) at this temperature causes additional problems.

In view of these considerations and in order to suppress or eliminate such drawbacks, embodiments of the invention provide a compound membrane for an electroacoustic transducer (like a speaker, a microphone, etc.), wherein the membrane comprises a damping layer having a sufficiently small variation of Young's modulus in a normal range of operation temperatures.

Next, further embodiments of the compound membrane will be explained, which embodiments also apply to the acoustic device and to the method of manufacturing a compound membrane.

According to an embodiment, the value of Young's modulus of the second layer does not vary more than 30% in a temperature range between −40° C. and +85° C., particularly in a temperature range between −55° C. and +85° C. It has been recognized by the inventors that these temperature ranges (upper limit defined by the maximum operating temperature, lower temperature limits defined by minimum temperatures at which the rigidness of the second layer is still acceptable for mechanical and acoustic purposes) are appropriate for compound membranes for electroacoustic devices.

According to an embodiment, the value of Young's modulus of the second layer does not vary more than 20% in a temperature range between −55° C. and +85° C., particularly does not vary more than 15% in a temperature range between −55° C. and +85° C.

The second layer may comprise a thermoplastic material. The thermoplastic material of the second layer should be relatively soft, for instance should be made of polyurethane or any other soft and gluey thermoplastic material. This allows the second layer to contribute to the damping properties of the compound membrane in an advantageous manner.

The thermoplastic material of the second layer may have a glass transition temperature in a temperature range between essentially −60° C. and essentially −10° C., preferably in a temperature range between essentially −50° C. and essentially −20° C., more particularly in a temperature range between essentially −40° C. and essentially −30° C. If the glass transition temperature of the material of the second layer is within a preferred temperature range (e.g. between −50° C. and −20° C.), it has no adverse effect on the acoustic performance during normal use of the device. Compound membranes are used increasingly for speaker membranes and are usually systems consisting of thermoplastic foils and glue. Different combinations and numbers of layers (for instance two or three) are possible. In many cases, at least one thermoplastic layer and one damping layer are required. The glass transition temperature $T_G$ of the glue should be far away from a temperature at which the speakers are tested ore operated. Otherwise, the parameters of the speaker, which are measured and used to control the process, will change very strongly with small changes in temperature. Anyway, the membrane should be operated above $T_G$ because if the system is used below $T_G$, the membrane will break, because it is too hard are brittle below $T_G$. However, if $T_G$ is too high, the second layer becomes hard what causes an undesired increase of the resonant frequency. Thus, an advantageous or optimized value of $T_G$ for the glue of the compound membrane was found by the inventors to be between −50° C. and −20° C. (for thermoplastic materials) depending on the lowest application temperature. Taking these measures may ensure essentially constant parameters for the process and a high lifetime of the speaker.

The second layer may, as an alternative to a thermoplastic, comprise silicone (for instance a material of a group of semi-inorganic polymers based on the structural unit $R_2SiO$, where R is an organic group). Since silicone is not a thermoplastic material, it is not possible to define a glass transition temperature for this material. However, a sufficiently small change of the Young's modulus of silicone in the above-described temperature ranges makes silicone be an appropriate material for the second layer of the compound membrane.

Also the first layer may comprise a thermoplastic material, which can be harder than the thermoplastic material of the second layer. Examples for appropriate materials are polycarbonate, polyetherimide, polyethyleneterephthalate, or polyethylenenaphthalate.

The thermoplastic material of the first layer may have a glass transition temperature in a range between essentially +120° C. and essentially +150° C. In other words, the glass transition temperature of the first layer should be sufficiently large so that, in a normal operation range which usually ends around +85° C., the first layer remains its rigidness and does not become soft. The glass transition temperature of the first layer should be larger than the glass transition temperature of the second layer.

The value of Young's modulus of the second layer should be smaller than a value of Young's modulus of the first layer. In other words, the second layer should be softer than the first layer. A combination of a soft second layer and a rigid first layer may ensure proper acoustic damping properties, allowing the compound membrane to damp undesired excited acoustic modes above a desired ground mode. This results in an excellent audio performance.

The second layer may have a thickness which is larger than a thickness of the first layer. However, the second layer should be made of a material being so soft that even a sufficiently thick second layer essentially does not contribute significantly to the stiffness of the compound membrane. This allows to improve or optimize the compound membrane with regard to damping properties by adjusting a thickness of the second layer, without a dominating impact on the stiffness of the entire membrane. For instance, the second layer may have a thickness of 30 μm whereas the first layer may have a thickness of 10 μm. However, it is also possible that both layers have the same thickness of, for instance, 25 μm.

The acoustic apparatus may be realized as at least one of the group consisting of a handheld sound reproduction system, a wearable device, a near-field sound reproduction system, headphones, earphones, a portable audio player, an audio surround system, a mobile phone, a headset, a hearing aid, a handsfree system, a television device, a TV set audio player, a video recorder, a monitor, a gaming device, a laptop, a DVD player, a CD player, a harddisk-based media player, an internet radio device, a public entertainment device, an MP3 player, a hi-fi system, a vehicle entertainment device, a car entertainment device, a medical communication system, a speech communication device, a home cinema system, a home theater system, a flat television apparatus, an ambiance creation device, and a music hall system.

The aspects defined above and further aspects of the invention are apparent from the examples of embodiment to be described hereinafter and are explained with reference to these examples of embodiment.

BRIEF DESCRIPTION OF THE DRAWINGS

The invention will be described in more detail hereinafter with reference to examples of embodiment but to which the invention is not limited.

DESCRIPTION OF EMBODIMENTS

Figure 1:
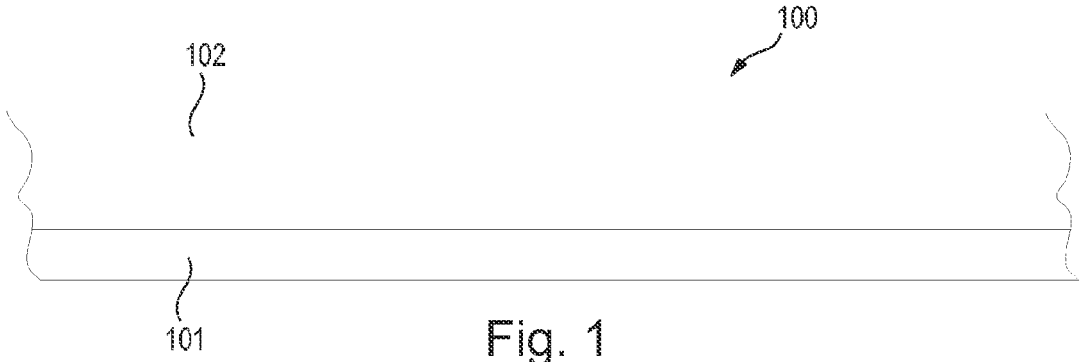
FIG. 1 shows a compound membrane according to an exemplary embodiment of the invention.

The illustration in the drawing is schematically. In different drawings, similar or identical elements are provided with the same reference signs.

FIG. 1 illustrates an oscillatory compound membrane 100 for a loudspeaker (or for a microphone) according to an exemplary embodiment of the invention.

The compound membrane 100 comprises a first layer 101 and a second layer 102 deposited on the first layer 101. A value of Young's modulus of the second layer 102 varies not more than 30% in a temperature range between −40° C. and +85° C. The second layer 102 comprises a thermoplastic material having a glass transition temperature between −50° C. and −20° C. The first layer 101 comprises a thermoplastic material (like polycarbonate) having a glass transition temperature between +120° C. and +150° C. The second layer 102 has a larger thickness than the first layer 101 and is softer than the first layer 101. In the combination of the layers 101, 102, the compound membrane 100 is capable of damping higher acoustic modes.

Figure 2:
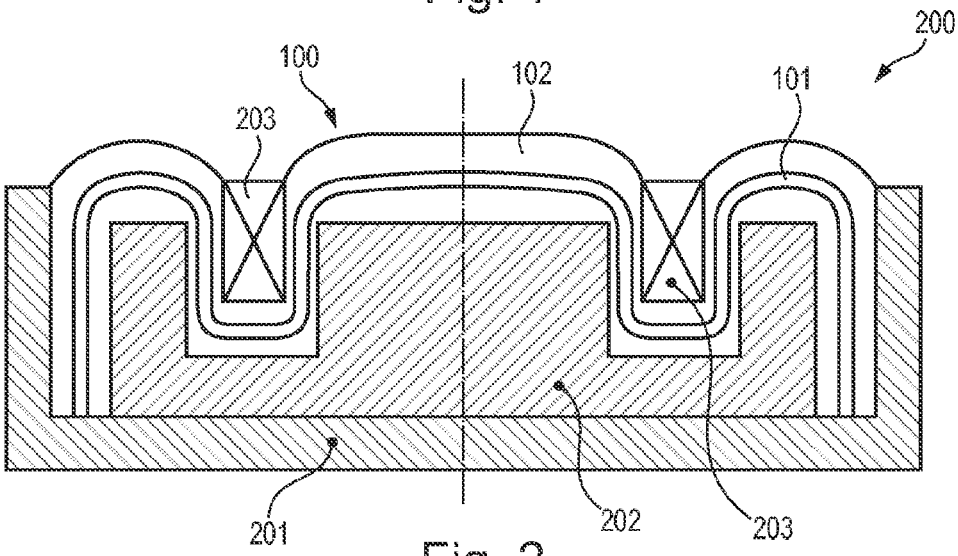
FIG. 2 shows an acoustic device according to an exemplary embodiment of the invention.

FIG. 2 shows a loudspeaker 200 as an acoustic device according to an exemplary embodiment of the invention.

The loudspeaker 200 comprises the compound membrane 100 formed by the first layer 101 and by the second layer 102 as an oscillatory diaphragm. Furthermore, FIG. 2 shows a housing or base member 201 and a magnetic arrangement 202. The base element 201 (which may also be denoted as a basket) may be made of any appropriate material, like metal or plastics, for instance polycarbonate. The magnetic arrangement 202 cooperates with a coil 203. When the coil 203 is activated by an electric audio signal, an electromagnetic force occurs between the coil 203 and the magnetic system 202. This causes the membrane 100 to be excited in accordance with the exciting acoustic signals, thereby generating acoustic waves, which are emitted to an environment perceivable by a human listener.

A portion of the compound membrane 100 inside the annular coil 203 is relatively rigid, whereas a portion of the compound membrane 100 being positioned close to vertical portions of the base member 201 is relatively flexible.

The first layer 101 is made of a rigid thermoplastic material and has a relatively high melting point. The second layer 102 is made of a softer thermoplastic material and has a lower melting point. Together, the first layer 101 and the second layer 102 form the compound membrane 100 which may function as a sealing member and a damping element selectively damping defined acoustic modes. As the first layer 101 is comparatively rigid, it mainly contributes to the bending properties and ensures that the membrane 100 keeps its shape. As the second layer 102 is comparatively soft, it mainly contributes to the damping properties of the compound membrane 100.

As an alternative to the loudspeaker 200, the compound membrane 100 may also be implemented in a microphone, or any other acoustic device.

In the following, a functional principle of embodiments of the invention will be explained.

Since, for generating acoustic waves with a loudspeaker, in many cases only the first (for instance "piston" shaped) oscillation mode is effective whereas higher modes negatively influence the sound quality of the loudspeaker, it may be appropriate to damp the higher modes. Since thin materials are implemented in a loudspeaker, particularly when the dimension of loudspeakers decreases, the damping effect of a single layer material may be too weak. Therefore, foil compounds comprising one or more cover foils are implemented, in many cases using thermoplastic materials (like polycarbonate (PC), polyetherimide (PEI), polyethyleneterephthalate (PET) or polyethylenenaphthalate (PEN) and one or a plurality of damping soft layers. The soft gluing layer does not significantly contribute to the stiffness of the system and can therefore be made thicker without making the loudspeaker significantly harder. This may enhance damping properties in the membrane foil.

The glues may be made of a thermoplastic material since these can be deformed by heating by typical membrane form processes. Many glues, however, have an undesired glass transition range.

Within the glass transition range, the elastic modules of the material varies very strongly even when the temperature is changed by only a few degrees Celsius, sometimes by more than one order of magnitude. If the glass transition range of the glue is exactly in the temperature range in which the loudspeakers are tested and operated, this has the undesired effect that the acoustic properties vary strongly with only very small temperature variation. Since the acoustic properties are used for controlling and monitoring the process during manufacture, a strong variation of the properties is very undesired and makes it difficult or even impossible to control a process.

In order to obtain a more reliable process, a simplified process control, a higher lifetime for loudspeakers in a temperature range defined by a user, and constant product properties with small tolerances within typical application temperature ranges, embodiments of the invention provide a glue which forms a damping layer of a compound foil and has a glass transition temperature between essentially −50° C. and −20° C.

For an advantageous temperature stability of the loudspeaker membrane, a sufficiently low glass transition range of the glue is desired. Materials with a high glass transition range, however, may be too hard and thus fulfil the purpose of damping only partially. The loudspeaker should not be operated below the glass transition range, since the membrane becomes very brittle in this temperature range.

These considerations, on which embodiments of the invention are based, result in an advantageous glass transition range of between −50° C. and −20° C., depending on the field of application of the loudspeaker. This guarantees that the properties which are used for process control remain sufficiently constant within a temperature range relevant for manufacture (for instance a factor 2 over 100° C.).

Membranes which are used below their glass transition range are prone to breaking and therefore have a reduced lifetime.

Figure 3:
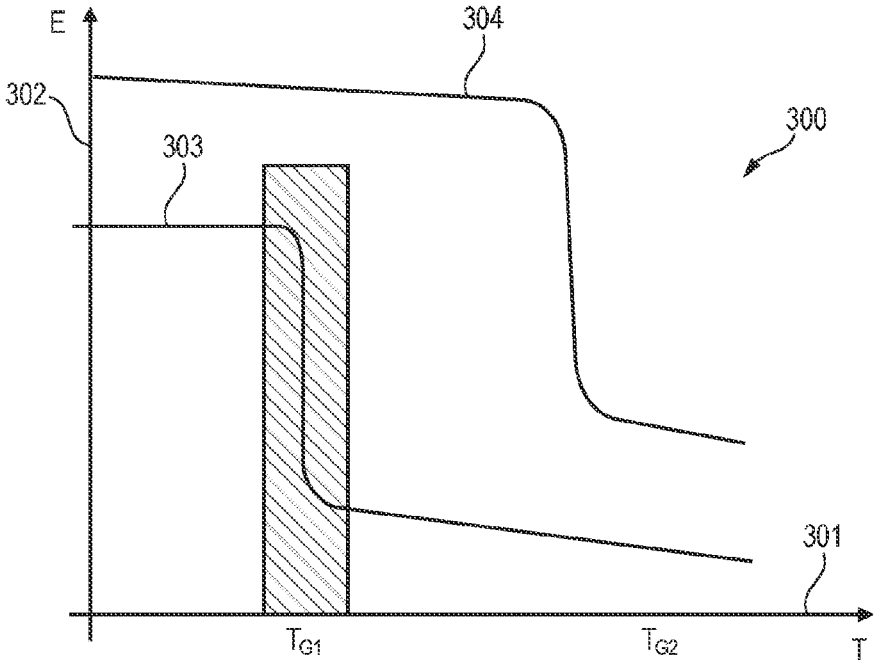
FIG. 3 shows a diagram illustrating a temperature dependence of a Young modulus for layers of a compound membrane according to an exemplary embodiment of the invention.

FIG. 3 shows a diagram 300 illustrating schematically a dependence between a temperature T (plotted along an abscissa 301) and Young's modulus of elasticity E (plotted along an ordinate 302).

A first curve 303 indicates a temperature dependence of Young's modulus of elasticity for the soft second layer 102. Furthermore, a second curve 304 schematically illustrates a temperature dependence for the hard first layer 101.

As can be seen in FIG. 3, the second curve 304 is always above the first curve 303, since the first layer 101 is more rigid than the soft layer 102. Furthermore, the glass transition temperature, $T_{G1}$, of the second layer 102 is significantly lower than the glass transition temperature, $T_{G2}$, of the first layer 101.

A suitable operating range of a corresponding membrane 100 for audio purposes is essentially between $T_{G1}$ and $T_{G2}$. Below $T_{G1}$, the compound membrane 100 becomes too brittle which may result in a bad lifetime and may become too hard which may result in poor acoustic properties. Close or above $T_{G2}$, even the hard first layer 101 becomes soft, thereby deteriorating the mechanic and acoustic properties of the compound membrane 100.

However, the operating range should be significantly away from the critical sections of the curves 303 and 304 where the Young's modulus E changes very strong with the temperature T. The hatched area around the glass transition temperature, $T_{G1}$, of the second layer 102 indicates an area which should be avoided for the operation of a membrane 100.

Finally, it should be noted that the above-mentioned embodiments illustrate rather than limit the invention, and that those skilled in the art will be capable of designing many alternative embodiments without departing from the scope of the invention as defined by the appended claims. In the claims, any reference signs placed in parentheses shall not be construed as limiting the claims. Use of the verb "comprise" and its conjugations do not exclude the presence of elements or steps other than those listed in any claim or the specification as a whole. The singular reference of an element does not exclude the plural reference of such elements and vice-versa. In a device claim enumerating several means, several of these means may be embodied by one and the same item of software or hardware. The mere fact that certain measures are recited in mutually different dependent claims does not indicate that a combination of these measures cannot be used to advantage.

The invention claimed is:

1. A compound membrane for an acoustic device, the compound membrane comprising:

a first layer;

a second layer connected to the first layer, wherein a value of Young's modulus of the second layer does not vary more than 30% in a temperature range between −20° C. and +85° C.

2. The compound membrane according to claim 1, wherein the value of Young's modulus of the second layer does not vary more than 30% in a temperature range between −40° C. and +85° C.

3. The compound membrane according to claim 1, wherein the second layer comprises or consists of a thermoplastic material.

4. The compound membrane according to claim 3, wherein the thermoplastic material of the second layer has a glass transition temperature in a temperature range between −60° C. and −10 C.

5. The compound membrane according to claim 1, wherein the second layer comprises of silicone.

6. The compound membrane according to claim 1, wherein the first layer comprises of a thermoplastic material.

7. The compound membrane according to claim 6, wherein the thermoplastic material of the first layer has a glass transition temperature in a temperature range between +120° C. and +150° C.

8. The compound membrane according to claim 1, wherein the value of Young's modulus of the second layer is smaller than a value of Young's modulus of the first layer.

9. The compound membrane according to claim 1, wherein the second layer is thicker than the first layer.

10. The compound membrane according to claim 1, wherein the first layer and the second layer have a thickness in a range between 1 μm and 150 μm.

11. The compound membrane according to claim 1, wherein the compound membrane is particularly adapted to at least one of the group comprising of an electroacoustic transducer, an electrodynamic acoustic device, a piezoelectric acoustic device, a speaker, a microphone, a receiver, and a vibrator.

12. A method of manufacturing a compound membrane for an acoustic device, the method comprising:

forming a second layer on a first layer, wherein a value of Young's modulus of the second layer does not vary more than 30% in a temperature range between −20° C. and +85° C.

* * * * *